US010043455B2

(12) United States Patent
Kim et al.

(10) Patent No.: US 10,043,455 B2
(45) Date of Patent: Aug. 7, 2018

(54) DATA DRIVER AND DISPLAY DEVICE INCLUDING THE SAME

(71) Applicants: LG Display Co., Ltd., Seoul (KR); Industry-University Cooperation Foundation Hanyang University, Seoul (KR)

(72) Inventors: SeungTae Kim, Goyang-si (KR); Oh Kyong Kwon, Seoul (KR)

(73) Assignee: LG Display Co., LTD, Seoul (KR)

( * ) Notice: Subject to any disclaimer, the term of this patent is extended or adjusted under 35 U.S.C. 154(b) by 101 days.

(21) Appl. No.: 14/829,483

(22) Filed: Aug. 18, 2015

(65) Prior Publication Data

US 2016/0055803 A1 Feb. 25, 2016

(30) Foreign Application Priority Data

Aug. 19, 2014 (KR) ..... 10-2014-0107525

(51) Int. Cl.
*G09G 3/3291* (2016.01)
*G09G 3/20* (2006.01)
*G09G 3/3233* (2016.01)

(52) U.S. Cl.
CPC ..... *G09G 3/3291* (2013.01); *G09G 3/2003* (2013.01); *G09G 3/3233* (2013.01); *G09G 2300/0452* (2013.01); *G09G 2300/0819* (2013.01); *G09G 2310/027* (2013.01); *G09G 2310/0251* (2013.01); *G09G 2310/0297* (2013.01); *G09G 2310/08* (2013.01); *G09G 2330/022* (2013.01); *G09G 2340/06* (2013.01)

(58) Field of Classification Search
CPC .. G09G 3/3291; G09G 3/2003; G09G 3/3233; G09G 2310/0297; G09G 2310/027; G09G 2310/08; G09G 2340/06; G09G 2300/0452; G09G 2300/0819; G09G 2310/0251; G09G 2330/022
See application file for complete search history.

(56) References Cited

U.S. PATENT DOCUMENTS

2003/0146909 A1 8/2003 Maki
2008/0068310 A1* 3/2008 Choi ..... G09G 3/3233 345/82
2008/0186322 A1* 8/2008 Polak ..... G09G 5/02 345/589

(Continued)

FOREIGN PATENT DOCUMENTS

CN 101632115 A 1/2010
CN 101663702 A 3/2010
CN 102881267 A 1/2013

OTHER PUBLICATIONS

Chinese First Office Action, Chinese Application No. 201510511131.0, dated Aug. 2, 2017, 30 pages.

*Primary Examiner* — Amr Awad
*Assistant Examiner* — Wing Chow
(74) *Attorney, Agent, or Firm* — Fenwick & West LLP

(57) ABSTRACT

A data driver and a display device including the same. The data driver includes a DA converting circuit converting a digital signal into an analog signal and an output circuit disposed downstream of the DA converting circuit. The output circuit outputs two selected color data signals and one black voltage based on the data state of one reference data signal, and outputs one fixed color data signal.

20 Claims, 25 Drawing Sheets

(56) References Cited

U.S. PATENT DOCUMENTS

| | | | | |
|---|---|---|---|---|
| 2010/0085293 | A1 | 4/2010 | Lee et al. | |
| 2010/0103201 | A1* | 4/2010 | Nakanishi | G09G 3/2003 345/690 |
| 2013/0016087 | A1* | 1/2013 | Kishikawa | H03F 3/3022 345/212 |

* cited by examiner

DATA DRIVER AND DISPLAY DEVICE INCLUDING THE SAME

CROSS REFERENCE TO RELATED APPLICATION

This application claims priority from and the benefit under 35 U.S.C. § 119(a) of Korean Patent Application Number 10-2014-0107525 filed on Aug. 19, 2014, which is hereby incorporated by reference for all purposes as if fully set forth herein.

BACKGROUND OF THE INVENTION

Field of the Invention

The present disclosure relates to a data driver and a display device including the same.

Description of Related Art

Following the development of information technology, the market for display devices serving as interfaces between users and information is also growing. Accordingly, the use of display devices, such as liquid crystal displays (LCDs), organic light-emitting diode (OLED) displays, electrophoretic displays (EPDs), and plasma display panels (PDPs), is increasing.

Organic light-emitting diodes (OLEDs) used in OLED displays are self-emitting devices in which a light-emitting layer is situated between two electrodes. Specifically, in an OLED, electrons are injected into a light-emitting layer through a cathode, or an electro injection electrode, and holes are injected into the light-emitting layer through an anode, or a hole injection electrode. The injected electrons and holes generate excitons, and when the excitons transit from an excited state to a ground state, light is emitted.

In OLED displays, when a scanning signal, a data signal, or power is supplied to a display panel, transistors or the like in selected subpixels of the display panel are driven. An image is displayed as OLEDs in the subpixels emit light in response to currents formed by the transistors or the like.

Some OLED displays are implemented as OLED displays having a subpixel structure including red, green, blue and white emitters (hereinafter referred to as "RGBW OLED displays") in order to prevent either the luminance of unmixed colors or an impression of unmixed colors from decreasing while increasing light efficiency.

RGBW OLED displays convert data signals input in an RGB format (RGB data signals) into RGBW data signals, and supply the RGBW data signals to a display panel. Therefore, RGBW OLED displays require a data driver including four digital-to-analog (DA) converters and four amplifiers in order to drive RGBW subpixels.

RGBW OLED displays advantageously prevent either the luminance of unmixed colors or an impression of unmixed colors from decreasing while increasing light efficiency. However, RGBW OLED displays proposed in the related art may have drawbacks of larger sizes and higher fabrication costs, as compared to OLED displays using RGB emitters only. Accordingly, it is necessary to improve upon the drawbacks.

BRIEF SUMMARY

Various aspects of the present disclosure provide a data driver, the size of which is reduced by decreasing the number of digital-to-analog (DA) converters or amplifiers, and a display device including the same.

In addition, also provided are a data driver able to reduce an input frequency and reduce static power consumption and a display device including the same.

According to an aspect of the present disclosure, provided is a data driver including: a DA converting circuit converting a digital signal into an analog signal; and an output circuit disposed downstream of the DA converting circuit, wherein the output circuit outputs two selected color data signals and one black voltage based on the data state of one reference data signal, and outputs one fixed color data signal.

According to another aspect of the present disclosure, provided is a display device including: a display panel; a data driver driving the display panel, wherein the data driver outputs two selected color data signals and one black voltage based on a data state of one reference data signal, and outputs one fixed color data signal; a timing controller controlling the data driver; and a system board supplying a variety of signals to the timing controller.

According to another aspect of the present disclosure, provided is a data driver for driving a light emitting diode (LED) display including a plurality of pixels, each pixel including a first color subpixel, a second color subpixel, a third color subpixel, and a fourth color subpixel. The data driver comprises a digital-to-analog converting circuit to convert first digital color data, second digital color data, third digital color data to a first color analog signal, a second color analog signal, and a third color analog signal, respectively. The data driver also comprises an output circuit coupled to the digital-to-analog converting circuit, the output circuit outputting the first color analog signal to the first color subpixel, the second color analog signal to the second color subpixel, a black voltage signal to the third color subpixel, and the third color analog signal to the fourth color subpixel.

According to another aspect of the present disclosure, provided is a light-emitting diode (LED) display device, comprising a display panel including a plurality of pixels, each pixel including a first color subpixel, a second color subpixel, a third color subpixel, and a fourth color subpixel. The LED display device also comprises a system board receiving RGB data signals for driving the display panel and generating, based on the RGB data signals, first digital color data, second digital color data, third digital color data and a reference data signal. A digital-to-analog converting circuit is also included in the LED display device to convert the first digital color data, the second digital color data, and the third digital color data to a first color analog signal, a second color analog signal, and a third color analog signal, respectively. The LED display device further includes an output circuit coupled to the digital-to-analog converting circuit, the output circuit outputting the first color analog signal to the first color subpixel, the second color analog signal to the second color subpixel, a black voltage signal to the third color subpixel, and the third color analog signal to the fourth color subpixel.

According to the present disclosure, it is possible to reduce the size of the data driver by decreasing the number of the DA converters.

In addition, according to the present disclosure, since the number of bits of data signals output from the timing controller is reduced, the frequency of signals input to the data driver can be reduced.

Furthermore, according to the present disclosure, since the number of the DA converters or amplifiers is reduced, the static power consumption of the data driver can be reduced.

In addition, according to the present disclosure, it is possible to reduce the fabrication cost of the data driver by reducing the number of the DA converters or amplifiers.

BRIEF DESCRIPTION OF THE DRAWINGS

The above and other objects, features and advantages of the present disclosure will be more clearly understood from the following detailed description when taken in conjunction with the accompanying drawings, in which.

DETAILED DESCRIPTION OF THE INVENTION

Figure 1:
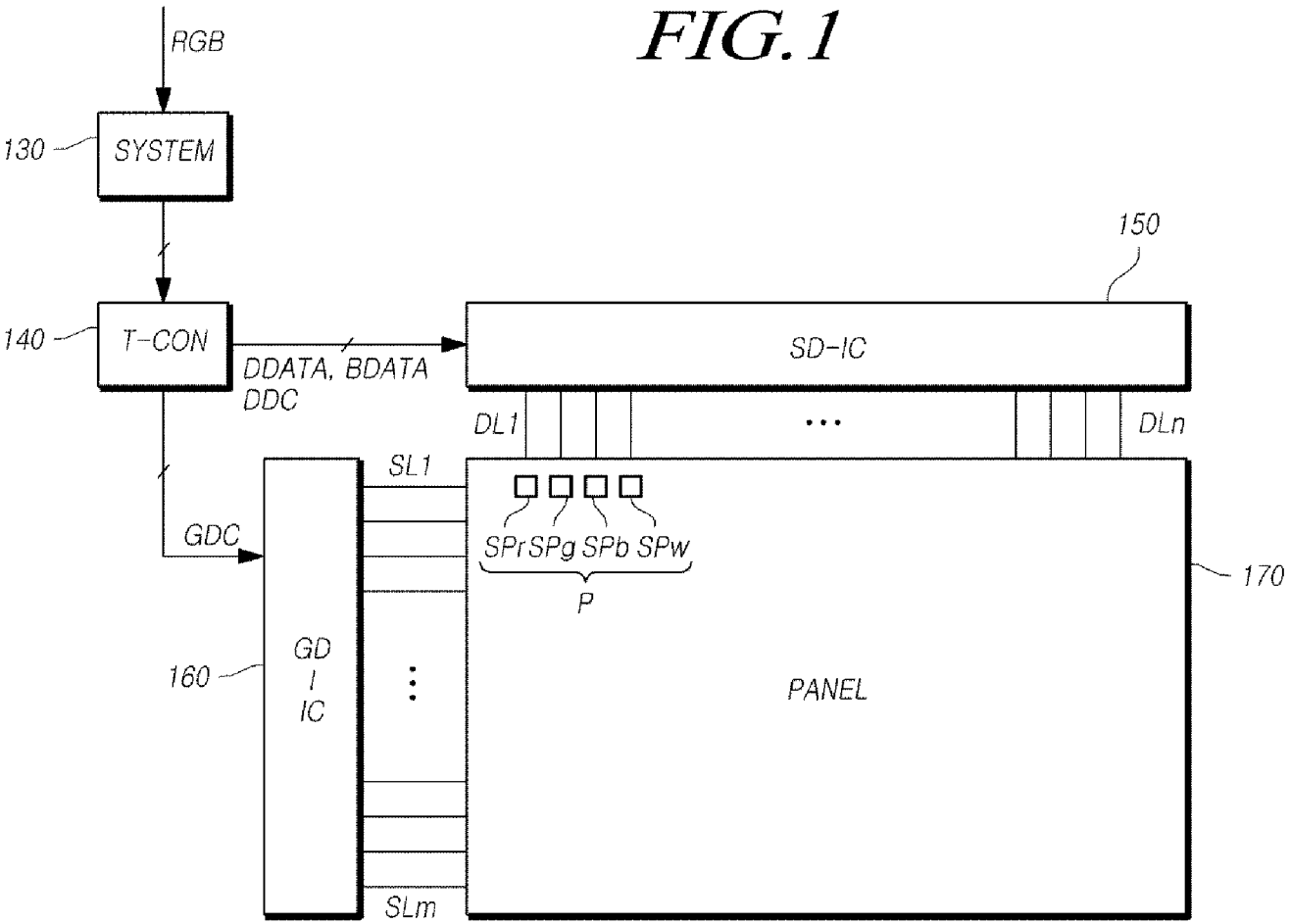
FIG. 1 illustrates a schematic configuration of an OLED display according to a first exemplary embodiment of the present disclosure.

Reference will now be made in detail to the present invention, embodiments of which are illustrated in the accompanying drawings. Throughout this document, reference should be made to the drawings, in which the same reference numerals and signs will be used to designate the same or like components. In the following description of the present invention, detailed descriptions of known functions and components incorporated herein will be omitted in the case that the subject matter of the present invention may be rendered unclear thereby.

Following the development of information technology, the market for display devices serving as interfaces between users and information is also growing. Accordingly, the use of display devices, such as liquid crystal displays (LCDs), organic light-emitting diode (OLED) displays, electrophoretic displays (EPDs), and plasma display panels (PDPs), is increasing.

Some OLED displays convert RGB data signals into RGBW data signals and display an image on a display panel using the RGBW data signals. However, RGBW OLED displays using RGBW data signals have larger sizes and, as a result, higher fabrication costs, as compared to OLED displays using RGB data signals only. Accordingly, it is necessary to improve upon these drawbacks.

In order to reduce the size and the fabrication cost of the data driver, embodiments of the present disclosure provide a data driver, in which an output circuit outputs two selected color data signals and one black voltage based on the data state of one reference data signal and outputs one fixed color data signal, and a display device including the same.

In the following description, an OLED display, a type of display device, will be given by way of example. However, the present disclosure is applicable to all types of display device converting RGB data signals into RGBW data signals and displaying an image on a display device using the RGBW data signals.

First Embodiment

Figure 2:
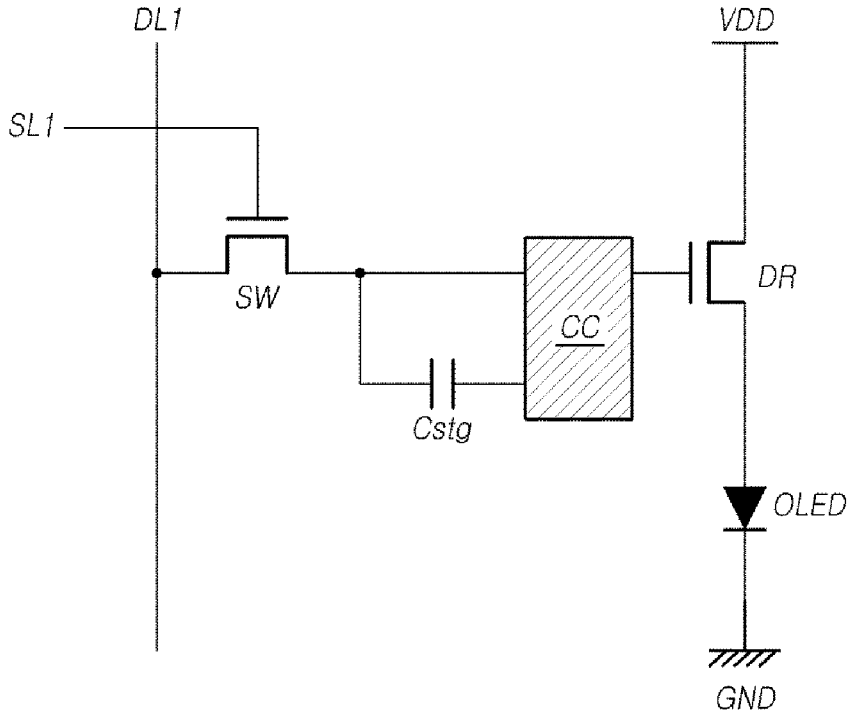
FIG. 2 illustrates a schematic circuit diagram of an exemplary subpixel.
Figure 3:
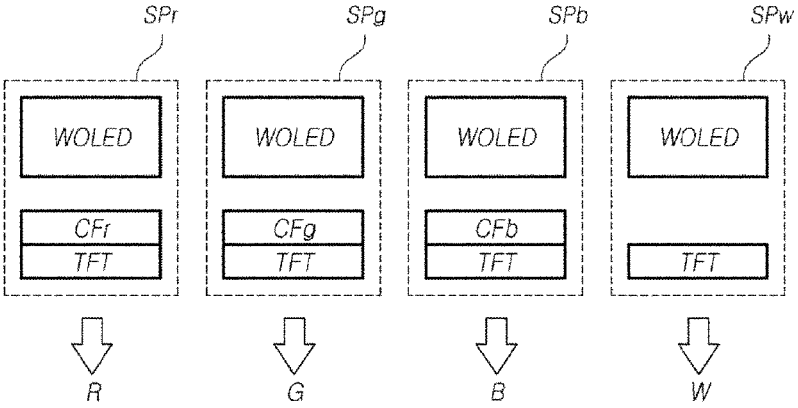
FIG. 3 is a schematic cross-sectional hierarchical view of the subpixel.
Figure 4A:
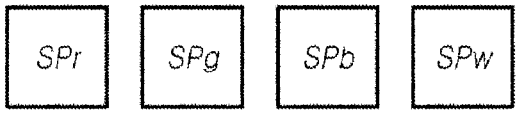
FIG. 4A, FIG. 4B, FIG. 4C, FIG. 4D, and FIG. 4E illustrate a variety of exemplary patterns in which subpixels are arranged.
Figure 4B:
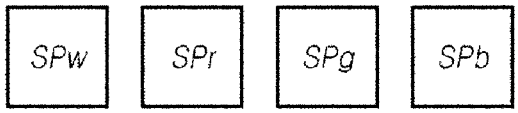
Figure 4C:
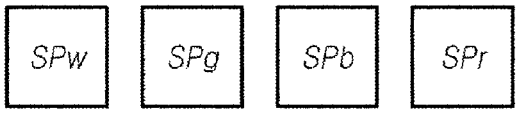
Figure 4D:
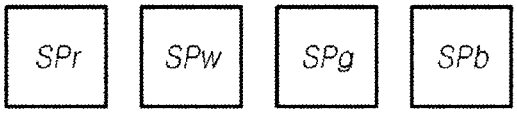
Figure 4E:
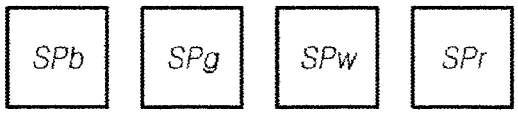
Figure 5:
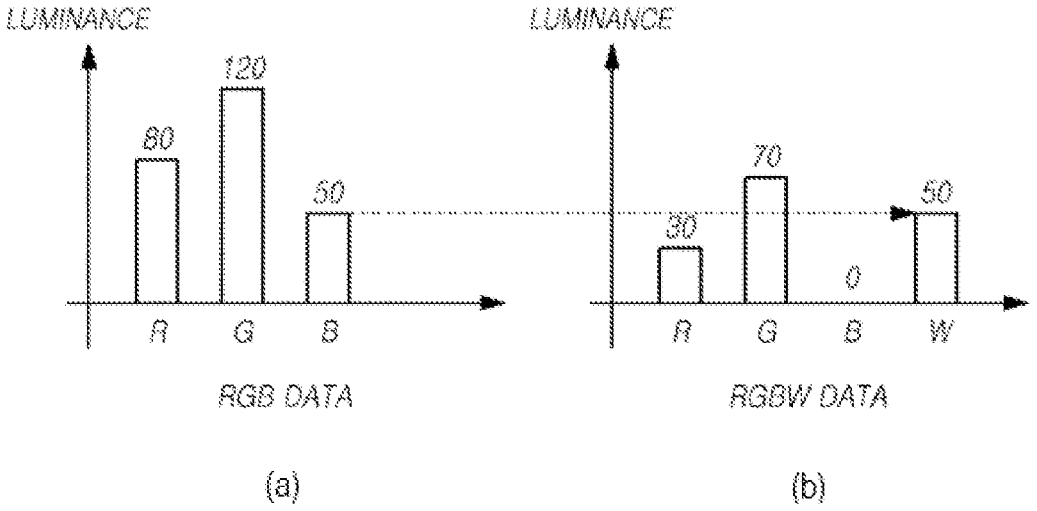
FIG. 5 illustrates an example in which data signals are converted.

FIG. 1 illustrates a schematic configuration of an OLED display according to a first exemplary embodiment of the present disclosure, FIG. 2 illustrates a schematic circuit diagram of an exemplary subpixel, FIG. 3 is a schematic cross-sectional hierarchical view of the subpixel, FIG. 4A, FIG. 4B, FIG. 4C, FIG. 4D, and FIG. 4E illustrate a variety of exemplary patterns in which subpixels are arranged, and FIG. 5 illustrates an example in which data signals are converted.

As illustrated in FIG. 1, the OLED display according to the first embodiment of the present disclosure includes a system board 130 (SYSTEM), a timing controller 140 (T-CON), a data driver 150 (SD-IC), a scanning driver 160 (GD-IC), and a display panel 170 (PANEL).

The system board 130 receives RGB data signals RGB supplied from an external source, converts the RGB data signals RGB into RGBW data signals, and outputs a driving signal, such as a data enable signal, a vertical synchronization signal, a horizontal synchronization signal, and a clock signal. The system board 130 converts the RGB data signals RGB into the RGBW data signals by classifying the RGB data signals depending on a data system including color data signals DDATA and a data system including a reference data signal BDATA. The color data signals DDATA may be defined as signals causing three subpixels selected from among the RGBW subpixels of the display panel 170 to emit light, while the reference data signal BDATA may be defined as a signal causing one subpixel unselected from among the RGBW subpixels of the display panel 170 not to emit light. The reference data signal BDATA is used as a selection signal controlling an output circuit included within the data driver 150. The operation of converting the RGB data signals RGB into the RGBW data signals may be executed by the timing controller 140 to be described later.

The timing controller 140 receives the color data signals DDATA and the reference data signal BDATA in addition to the driving signal, such as the data enable signal, the vertical synchronization signal, the horizontal synchronization signal, and the clock signal, from the system board 130. The timing controller 140 outputs a gate timing control signal GDC controlling the operation timing of the scanning driver 160 based on the driving signal and a data timing control signal DDC controlling the operation timing of the data driver 150 based on the driving signal. The timing controller 140 outputs the color data signals DDATA and the reference data signal BDATA in response to the gate timing control signal GDC and the data timing control signal DDC generated based on the driving signal.

The data driver 150 samples and latches the color data signals DDATA in response to the data timing control signal DDC supplied from the timing controller 140, and converts the color data signals DDATA into analog data in correspondence with a gamma reference voltage. The data driver 150 outputs two color data signals and one fixed data signal through data lines DL1 to DLn in correspondence with the reference data signal BDATA, the two color data signals being selected from among RGBW data signals included in the color data signals DDATA. The data driver 150 may be implemented as an integrated circuit (IC).

The scanning driver 160 outputs a scanning signal while shifting the level of a gate voltage in response to the gate timing control signal GDC supplied from the timing controller 140. The scanning driver 160 outputs a scanning signal through scanning lines SL1 to SLm. The scanning driver 160 may be implemented as an IC or may be implemented as a gate-in-panel circuit on the display panel 170.

The display panel 170 has a subpixel structure including a red subpixel SPr, a green subpixel SPg, a blue subpixel SPb, and a white subpixel SPw (hereinafter referred to as "RGBW subpixels") in order to prevent either the luminance or impression of unmixed colors from decreasing while increasing light efficiency. That is, one pixel P includes RGBW subpixels SPr, SPg, SPb, and SPw. A plurality of such pixels P corresponding to the resolution of the display panel 170 are provided.

As illustrated in FIG. 2, one subpixel includes a switching transistor SW, a driving transistor DR, a capacitor Cstg, a compensation circuit CC, and an organic light-emitting diode (OLED). The OLED operates to emit light in response to a drive current generated by the driving transistor DR. The switching transistor SW executes a switching operation such that the color data signal supplied through the first data line DL1 is stored as a data voltage in the capacitor Cstg in response to the scanning signal supplied through the first scanning line SL1. The driving transistor DR operates such that a drive current flows between a first power line VDD and a ground line GND according to the data voltage stored in the capacitor Cstg.

The compensation circuit CC is a circuit added in order to compensate for a threshold voltage of the driving transistor DR or the like. Although the compensation circuit CC may be omitted depending on the configuration of the subpixel, the compensation circuit CC generally includes at least one transistor and at least one capacitor. The compensation circuit CC may have a variety of configurations, and a detailed description and illustration of the configuration of the compensation circuit CC will be omitted.

A single subpixel has a two-transistor and one-capacitor (2T1C) structure including the switching transistor SW, the driving transistor DR, capacitor Cstg, and the OLED. When the compensation circuit CC is added, the single subpixel may have a 3T1C structure, a 4T2C structure, a 5T2C structure, or the like. The subpixel having the above-described configuration may be embodied as a top emission type, a bottom emission type, or a dual emission type according to the structure thereof.

The RGBW subpixels SPr, SPg, SPb, and SPw are embodied as a subpixel type using red, green, blue and white OLEDs or a subpixel type using white OLEDs (WOLEDs) and RGB color filters CFr, CFg, and CFb. The details of the RGBW subpixel type using the white OLEDs (WOLEDs) and the RGB color filters CFr, CFg, and CFb are as follows.

As illustrated in FIG. 3, in the RGBW subpixels SPr, SPg, SPb, and SPw, each of the RGB subpixels SPr, SPg, and SPb includes a transistor TFT, a corresponding color filter of the RGB color filters CFr, CFg, and CFb, and one WOLED. In contrast, the white subpixel SPw includes a transistor TFT and an WOLED. The RGB subpixels SPr, SPg, and SPb include the RGB color filters CFr, CFg, and CFb since white light emitted from the WOLED is converted into red, green, and blue wavelengths of light. In contrast, the white subpixel SPw does not include a color filter, in general, since white light emitted from the WOLED radiates outwardly therethrough. In some cases, the white subpixel SPw uses a white color filter having a high transmittance.

According to the type using the RGBW subpixels SPr, SPg, SPb, and SPw, a white light-emitting material is deposited on all subpixels, unlike a type in which each of red, green, and blue light-emitting materials is deposited on the corresponding subpixel. This type makes it easy to increase the size of the display device without using a fine metal mask. Assuming the transmittance of the color filter is 50%, the efficiency of the W subpixel is at least two times the efficiency of each of the RGB subpixels. Therefore, it is possible to increase the lifespan of the display device and reduce the power consumption of the display device depending on the ratio at which the W subpixels are used.

In the display panel 170, the subpixels may be arranged in a variety of patterns in order to improve color purity or expressiveness or to match target color coordinates. For example, as illustrated in FIG. 4A, the display panel 170 may have a structure in which the subpixels are arranged in the sequence of RGBW subpixels SPr, SPg, SPb, and SPw. In addition, as illustrated in FIG. 4B, the display panel 170 may have a structure in which the subpixels are arranged in the sequence of WRGB subpixels SPw, SPr, SPg, and SPb. Furthermore, as illustrated in FIG. 4C, the display panel 170 may have a structure in which the subpixels are arranged in the sequence of WGBR subpixels SPw, SPg, SPb, and SPr. In addition, as illustrated in part FIG. 4D, the display panel 170 may have a structure in which the subpixels are arranged in the sequence of RWGB subpixels SPr, SPw, SPg, and SPb. Furthermore, as illustrated in FIG. 4E, the display panel 170 may have a structure in which the subpixels are arranged in the sequence of BGWR subpixels SPb, SPg, SPw, and SPr. In addition to the illustrated and described examples, the display panel 170 may have other subpixel structures in which the subpixels are arranged in a variety of sequences.

The above-described OLED display performs compensation emission using the W subpixel as well as part or all of the RGB subpixels SPr, SPg, and SPb in order to express intended color coordinates on the display panel 170 using the RGBW subpixels SPr, SPg, SPb, and SPw.

For this, the system board 130 converts RGB data signals into color data signals including RGBW data signals and a reference data signal using an internal algorithm. The system board 130 may execute data conversion based on a color data signal having the lowest luminance value from among the RGB data signals. As described above, the operation of converting the RGB data signals into the color data signals including the RGBW data signals and the reference data signal may be executed by the timing controller 140 to be described later.

For example, as illustrated in FIG. 5, the value of the of luminance of the B data signal is lower than that of the R and G data signals. Thus, the value of the luminance of the W data signal takes over the value of the luminance of the B data signal, and the B data signal is set to 0. In addition, the values of luminance of the RG data signals are reduced based on the luminance of the B data signal, which is set to 0. Consequently, while the values of luminance of the RGB data signals are set to 80, 120, and 50 before the conversion of data (see part (a) of FIG. 5), the values of luminance of the RGBW data signals are changed to 30, 70, 0, and 50 after the conversion of data (see part (b) of FIG. 5). In this case, the RGW data signals become color data signals since none of the values of luminance thereof is 0, while the B data signal becomes a reference signal since the value of luminance thereof is 0.

It should be understood that the above example was described by expressing the values of luminance with simplified numeric values for better understanding of data conversion. In addition, it was described in the above example that the value of the luminance of the W data signal takes over the value of the luminance of the B data signal corresponding to the 1:1 relationship and that the values of the luminance of the R and G data signals are lowered by the same numerical value in correspondence with the value of the luminance of the B data signal.

However, this is for illustrative purposes only. In some compensation methods, one of the values of the luminance of the RGB data signals may be set to 0, and the values of the luminance of data signals, none of which is 0, may be reduced at different ratios.

A detailed description of the data driver of the OLED display according to the first embodiment of the present disclosure will be given below.

Figure 6:
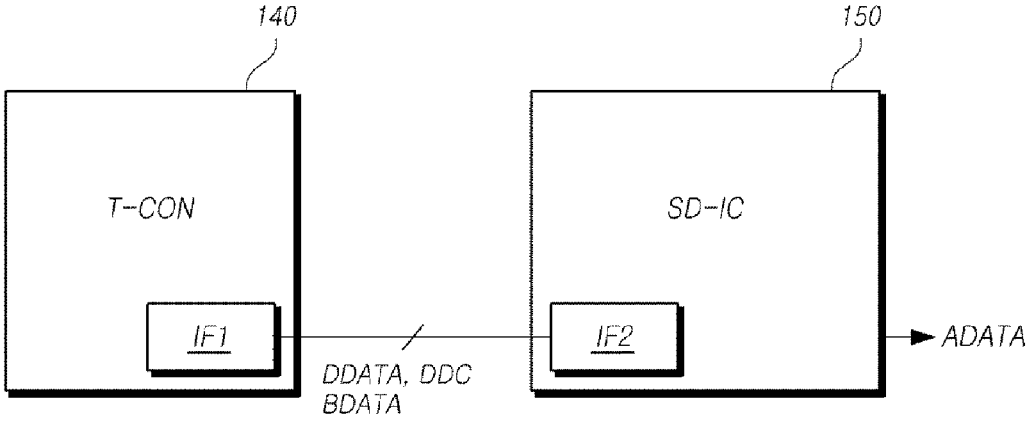
FIG. 6 illustrates an exemplary interface between the timing controller and the data driver.
Figure 7:
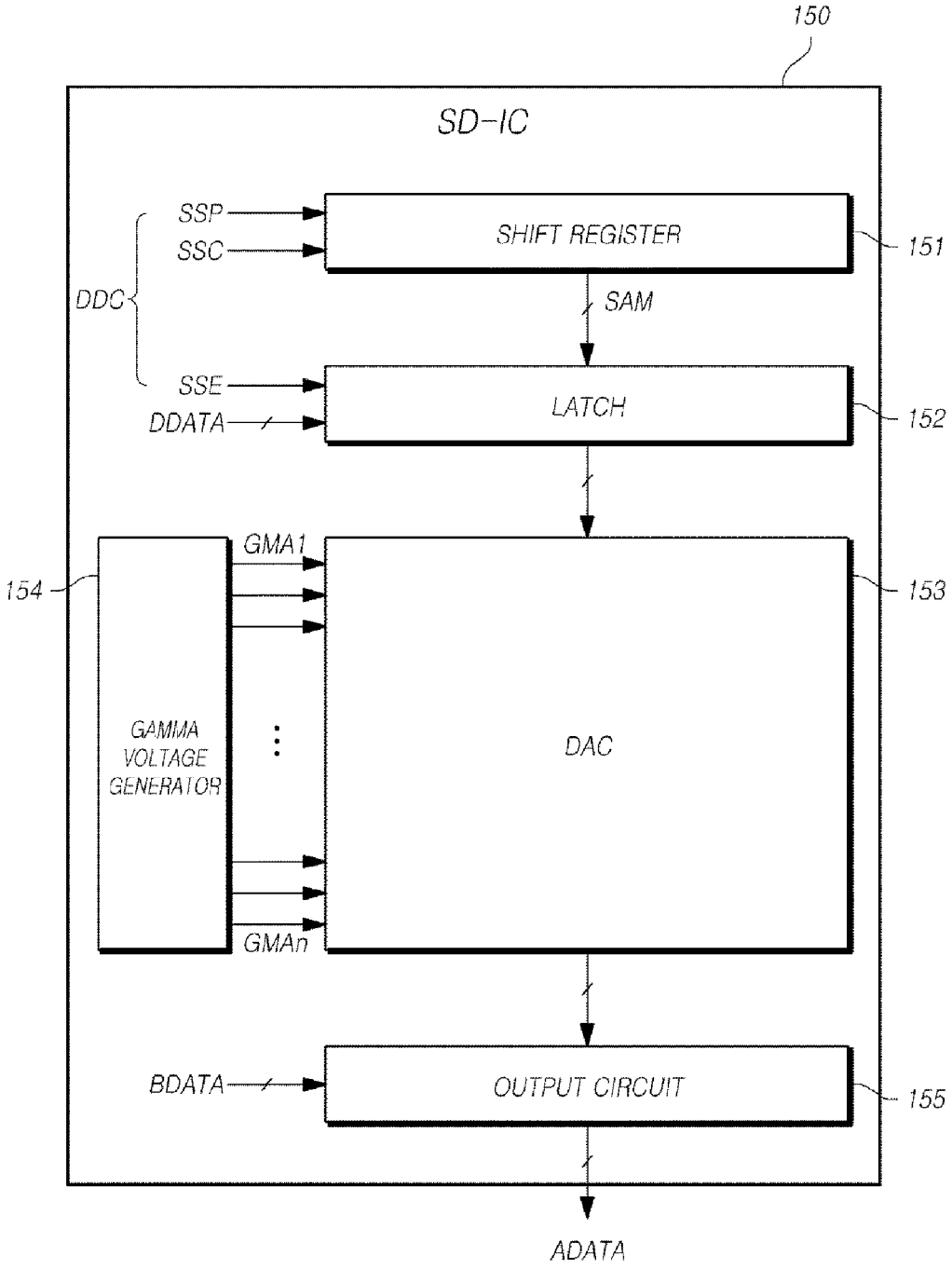
FIG. 7 illustrates a schematic configuration of the data driver.
Figure 8A:
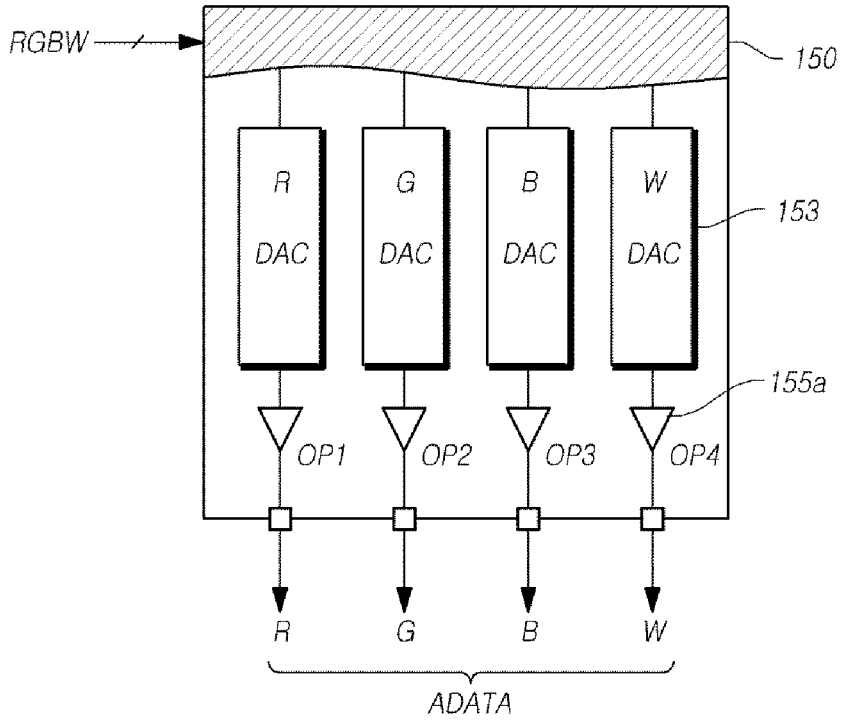
FIG. 8A and FIG. 8B comparatively illustrate part of the configuration of a data driver of the related art and part of the configuration of the data driver according to the first embodiment of the present disclosure.
Figure 8B:
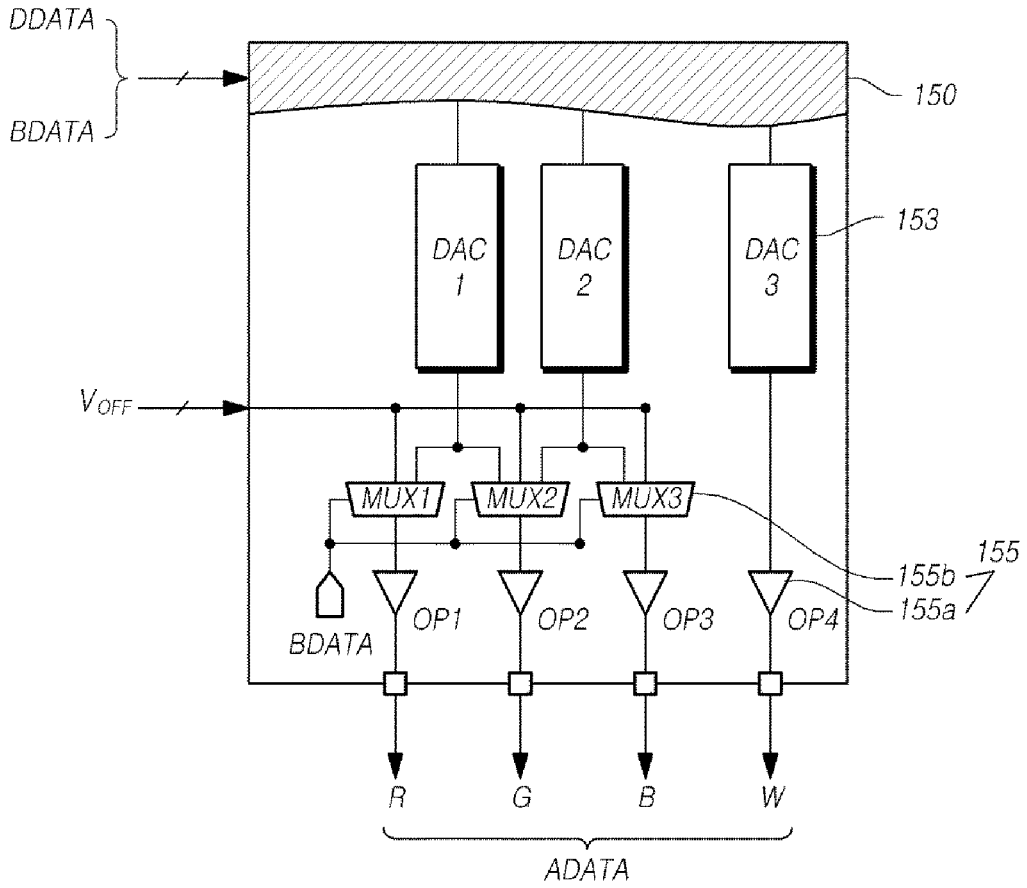
Figure 9A:
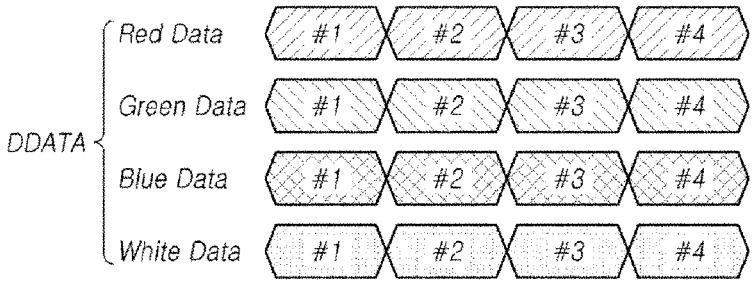
FIG. 9A and FIG. 9B comparatively illustrate a data signal format supplied to the data driver of the related art and a data signal format supplied to the data driver according to the first embodiment of the present disclosure.
Figure 9B:
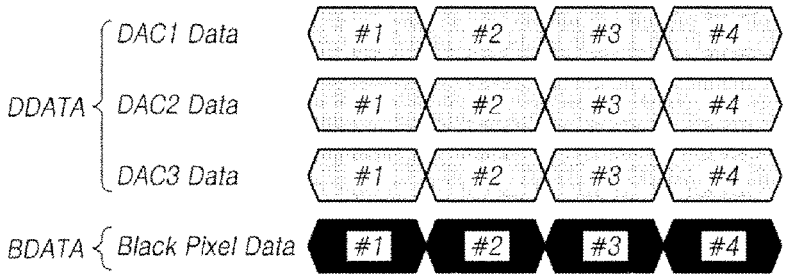

FIG. 6 illustrates an exemplary interface between the timing controller and the data driver, FIG. 7 illustrates a schematic configuration of the data driver, FIG. 8A illustrates part of the configuration of a data driver of the related art, FIG. 8B illustrates part of the configuration of the data driver according to the first embodiment of the present disclosure, and FIG. 9A illustrates a data signal format supplied to the data driver of the related art, FIG. 9B illustrates a data signal format supplied to the data driver according to the first embodiment of the present disclosure.

As illustrated in FIG. 6, the timing controller 140 and the data driver 150 are connected to each other by data communication interfaces IF1 and IF2. The timing controller 140 transmits color data signals DDATA and a reference data signal BDATA as well as a data timing control signal DDC via the first interface IF1 thereof. The data driver 150 receives the color data signals DDATA and the reference data signal BDATA as well as the data timing control signal DDC via the second interface IF2 thereof. In correspondence with the received reference data signal BDATA, the data driver 150 outputs two color data signals and one fixed W data signal by selecting the two color data signals from among the RGB data signals included in the color data signals ADATA.

As illustrated in FIG. 7, the data driver 150 includes a shift register 151, a latch 152, a gamma voltage generator 154, a digital-to-analog converting circuit (hereinafter referred to as a "DA converting circuit") 153, and an output circuit 155.

The data timing control signal DDC output from the timing controller 140 includes a source start pulse SSP, a source sample clock SSC, a source output enable signal SOE, and the like. The source start pulse SSP controls a point of time where the data driver 150 starts data sampling. The source sample clock SSC is a clock signal controlling the data sampling operation within the data driver 150 based on a rising or falling edge. The source output enable signal SOE controls the output of the data driver 150.

The shift register 151 outputs a sampling signal SAM in response to the source start pulse SSP and the source sampling clock SSC output from the timing controller 140.

The latch 152 sequentially samples digital color data signals DDATA in response to the sampling signal SAM output from the shift register 151, and simultaneously outputs color data signals DDATA of the sampled one line in correspondence with the source output enable signal SOE. The latch 152 was illustrated and described as being a single latch, although at least two latches may be provided.

The gamma voltage generator 154 generates first to nth gamma grayscale voltages GMA1 to GMAn in correspondence with a voltage or signal supplied from an external or internal source. In a liquid crystal display (LCD), the first to nth gamma grayscale voltages GMA1 to GMAn include a positive gamma grayscale voltage and a negative gamma grayscale voltage. That is, the gamma voltage generator 154 may include a positive gamma voltage generator generating a positive gamma grayscale voltage and a negative gamma grayscale voltage generator generating a negative gamma grayscale voltage according to the characteristics of the display device.

In correspondence with the first to nth gamma grayscale voltages GMA1 to GMAn, the DA converting circuit 153 converts the color data signals DDATA of one line into analog color data signals ADATA. The DA converting circuit 153 outputs two color data signals selected from among the RGB data signals and one fixed data signal.

The output circuit 155 amplifies (or amplifies and compensates for) the analog color data signals ADATA output from the DA converting circuit 153, and outputs the amplified (or amplified and compensated) analog color data signals ADATA to the data lines. The output circuit 155 outputs the two data signals selected from among the RGB data signals included in the analog color data signals ADATA in correspondence with the digital reference data signal BDATA and outputs one fixed data signal.

Hereinafter, the related art and the first embodiment of the present disclosure will be comparatively described with reference to one pixel driver included in the data driver 150.

As illustrated in FIG. 8A, in a typical data driver 150, a single pixel driver includes a DA converting circuit 153 and an amplifier circuit 155*a*. Specifically, the DA converting circuit 153 includes a red DA converter R DAC, a green DA converter G DAC, a blue DA converter B DAC, and a white DA converter W DAC. The red DA converter R DAC converts an R data signal driving a red subpixel into an analog format. The green DA converter G DAC converts a G data signal driving a green subpixel into an analog format. The blue DA converter B DAC converts a B data signal driving a blue subpixel into an analog format. The white DA converter W DAC converts a W data signal driving a white subpixel into an analog format.

The amplifier circuit 155*a* includes a first amplifier OP1, a second amplifier OP2, a third amplifier OP3, and a fourth amplifier OP4. The input terminal of the first amplifier OP1 is connected to the output terminal of the red DA converter R DAC. The first amplifier OP1 amplifies the R data signal. The input terminal of the second amplifier OP2 is connected to the output terminal of the green DA converter G DAC. The second amplifier OP2 amplifies the G data signal. The input terminal of the third amplifier OP3 is connected to the output terminal of the blue DA converter B DAC. The third amplifier OP3 amplifies the B data signal. The input terminal of the fourth amplifier OP4 is connected to the output terminal of the white DA converter W DAC. The fourth amplifier OP4 amplifies the W data signal.

As illustrated in FIG. 8A, a typical timing controller transmits digital data signals DDATA to the data driver 150 by dividing the digital data signals DDATA into RGBW data signals. When each data of the RGBW data signals is set to, for example, 10 bits, the total data of the RGBW data signals become 40 bits.

Since the digital data signals DDATA in the above-described format are supplied from the timing controller, the typical data driver 150 requires four DA converters for the DA converting circuit 153 and four amplifiers for the amplifier circuit 155*a*.

The data driver 150 converts the digital data signals DDATA into analog RGBW data signals ADATA using the four DA converters of the DA converting circuit 153 and the four amplifiers of the amplifier circuit 155*a* provided in correspondence with the number of the RGBW data signals Red Data, Green Data, Blue Data, and White Data, and outputs the analog RGBW data signals ADATA.

In the design of the data driver 150, the DA converting circuit 153 takes the largest area from among the circuits within the data driver 150. Therefore, in the typical data driver 150, the increased number of the DA converters of the DA converting circuit 153 increases the size and fabrication costs of the data driver compared to the data driver using RGB data signals only.

As illustrated in FIG. 8B, in the data driver 150 according to the first embodiment of the present disclosure, one pixel driver includes a DA converting circuit 153 and an output circuit 155. Specifically, the DA converting circuit 153 includes a first DA converter DAC1 and a second DA converter DAC2 that selectively drive red, green, blue, and white subpixels and a third DA converter DAC3 that drives a white subpixel. Compared to the above-described typical data driver, one DA converter is omitted from the data driver 150 according to the first embodiment of the present disclosure.

Each of the first DA converter DAC1 and the second DA converter DAC2 selectively receives data signals for at least two colors, and converts the data signal of one color of the at least two colors into an analog format. The third DA converter DAC3 receives a data signal for a single color, and converts the data signal for the one fixed color into an analog format.

The output circuit 155 includes a multiplexer circuit 155*b* and an amplifier circuit 155*a*. The multiplexer circuit 155*b* includes a first multiplexer MUX1, a second multiplexer MUX2, and a third multiplexer MUX3. The input terminal of the first multiplexer MUX1 is connected to the output terminal of the first DA converter DAC1. The first input terminal of the second multiplexer MUX2 is connected to the output terminal of the second DA converter DAC2, and the second input terminal of the second multiplexer MUX2 is connected to the output terminal of the first DA converter DAC1. The first input terminal of the third multiplexer MUX3 is connected to the output terminal of the second multiplexer MUX2. The third input terminals of the first to third multiplexers MUX1 to MUX3 are commonly connected to a black voltage line $V_{OFF}$ through which a black voltage is supplied. The selection terminals of the first to third multiplexers MUX1 to MUX3 are commonly connected to a signal line through which a reference data signal BDATA is transferred. In the above description, the multiplexer circuit 155*b* was taken for the sake of explanation. However, the present disclosure is not limited thereto since the multiplexer circuit may be substituted with any circuit (e.g. a transistor) able to output a specific data signal in correspondence with a specific selection signal.

The amplifier circuit 155*a* includes a first amplifier OP1, a second amplifier OP2, a third amplifier OP3, and a fourth amplifier OP4. The input terminal of the first amplifier OP1 is connected to the output terminal of the first multiplexer MUX1. The input terminal of the second amplifier OP2 is connected to the output terminal of the second multiplexer MUX2. The input terminal of the third amplifier OP3 is connected to the output terminal of the third multiplexer MUX3. The input terminal of the fourth amplifier OP4 is connected to the output terminal of the third DA converter DAC3.

As illustrated in FIG. 9B, the timing controller according to the first embodiment of the present disclosure transmits the digital data signals DDATA and BDATA to the data driver 150 by dividing the digital data signals DDATA and BDATA into the color data signals DDATA including first, second, and third data signals DAC1 Data, DAC2 Data, and DAC3 Data and the reference data signal BDATA including black pixel data "Black Pixel Data."

At this time, each data of the color data signals DDATA including the first to third data signals DAC1 Data, DAC2 Data, and DAC3 Data may be set to, for example, 10 bits. The data of the reference data signal BDATA including the black pixel data may be set lower by at least two bits than each data of the color data signals DDATA. For example, the data of the reference data signal BDATA may be set to 2 to 8 bits.

When the data of the reference data signal BDATA are set to 2 bits, the total data of the digital data signals DDATA and BDATA become 32 bits. That is, when data signals are transmitted in the signal format according to the first embodiment of the present disclosure, maximum eight bits can be reduced compared to the related art. Accordingly, the first embodiment of the present disclosure can reduce the number of bits of data signals compared to the related art, thereby reducing the frequency of signals input to the data driver.

As described above, the data driver 150 converts the two data signals and the single fixed data signal into the analog data signals ADATA in correspondence with the data state of the reference data signal BDATA, the two data signals being selected from among the RGB data signals included in the color data signals DDATA, and outputs the analog data signals ADATA.

The first to third data signals DAC1 Data, DAC2 Data, DAC3 Data of the color data signals DDATA cause three subpixels selected from among the RGBW subpixels of the display panel to emit light. In addition, the black pixel data of the reference data signal BDATA causes the unselected subpixel of the RGBW subpixels of the display panel not to emit light. That is, the color data signals DDATA are used as data signals expressing colors on the display panel, whereas the reference data signal BDATA is used as a selection signal controlling the output circuit 155 included within the data driver 150.

The data driver 150 according to the first embodiment of the present disclosure receives the digital data signals DDATA and BDATA having the above-described format from the timing controller. As described above, the color data signals DDATA include two data signals selected from among the RGB data signals and one fixed data signal. For example, the color data signals DDATA are in the form of GBW data signals, RBW data signals, or RGW data signals in which one signal from among the RGBW data signals is omitted.

Since the data signals having the above-described format are output from the timing controller, the DA converting circuit 153 of the data driver 150 includes three DA converters in correspondence with the number of the color data signals DDATA. Accordingly, the number of DA converters of the data driver 150 according to the first embodiment of the present disclosure can be significantly reduced with the increasing number of pixels (or the increasing resolution) of the display panel compared to that of the data driver of the related art. Since the number of DA converters of the data driver 150 according to the first embodiment of the present disclosure can be reduced, it is possible to design the data driver having a smaller size and reduce design costs. In addition, in the data driver 150 according to the first embodiment of the present disclosure, the multiplexer circuit 155*b* may include small multiplexers since data signals output from the DA converting circuit 153 are input to the multiplexer circuit 155*b* between the DA converting circuit 153 and the amplifier circuit 155*a* before the data signals are amplified by the amplifier circuit 155*a*. Since the multiplexer circuit 155*b* may be composed of small multiplexers, the data driver 150 according to the first embodiment of the present disclosure is applicable to a large display device having a screen size of, for example, 55 inches or greater.

For better understanding of the data driver according to the first embodiment of the present disclosure, an exemplary description will be added below.

Figure 10:
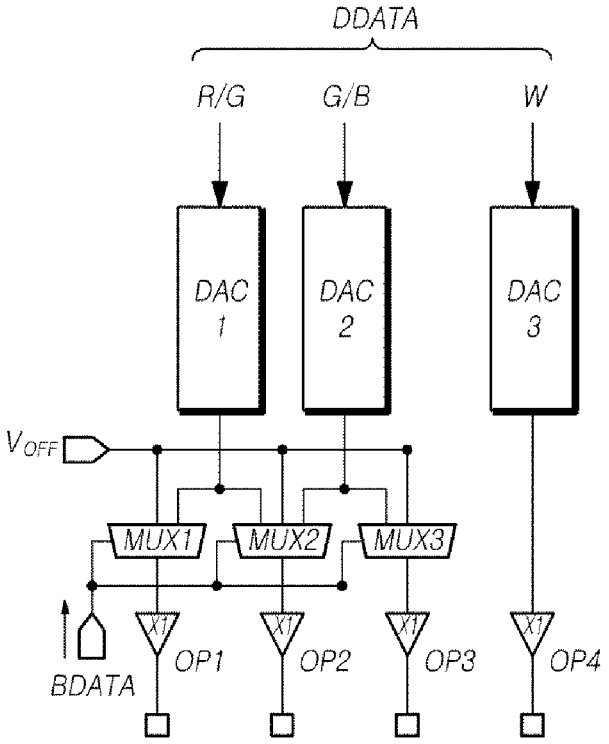
FIG. 10 illustrates an exemplary partial configuration of the data driver according to the first embodiment of the present disclosure.
Figure 11A:
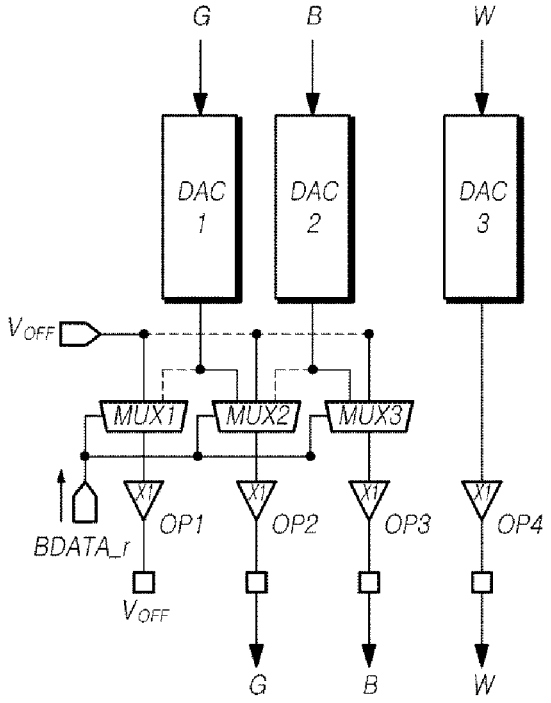
FIG. 11A, FIG. 11B, and FIG. 11C illustrate exemplary operations of the data driver according to the first embodiment of the present disclosure.
Figure 11B:
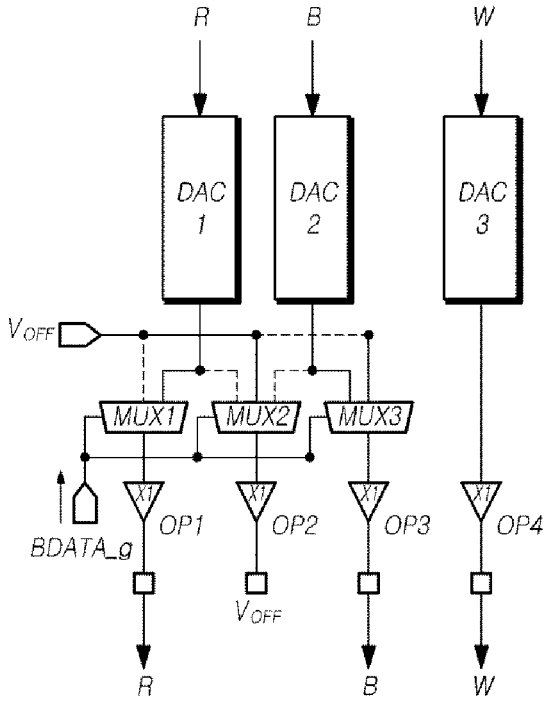
Figure 11C:
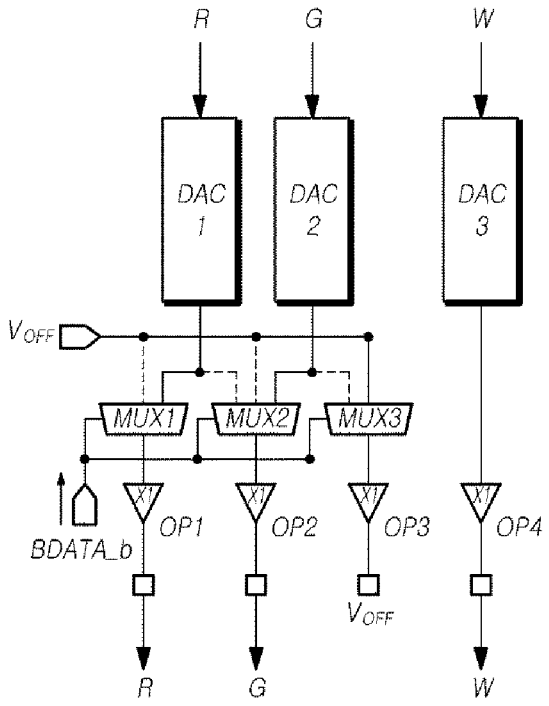

FIG. 10 illustrates an exemplary partial configuration of the data driver according to the first embodiment of the present disclosure, and FIG. 11A, FIG. 11B, and FIG. 11C illustrate exemplary operations of the data driver according to the first embodiment of the present disclosure.

As illustrated in FIG. 10, each of the first DA converter DAC1 and the second DA converter DAC2 selectively receives data signals for at least two colors, and converts the data signal for one color from among the received data signals into an analog format. The third DA converter DAC3 fixedly receives a data signal for one color, and converts the data signal for the fixed one color into an analog format.

For example, the first DA converter DAC1 converts an R or G data signal R/G driving the red or green subpixel into an analog format. The second DA converter DAC2 converts a G or B data signal G/B driving the green or blue subpixel into an analog format. The third DA converter DAC3 converts a W data signal W driving the white subpixel into an analog format.

The first input terminal of the first multiplexer MUX1 is connected to the output terminal of the first DA converter DAC1. The first multiplexer MUX1 activates the output of the R data signal. The first input terminal of the second multiplexer MUX2 is connected to the output terminal of the second DA converter DAC2, and the second input terminal of the second multiplexer MUX2 is connected to the output terminal of the first DA converter DAC1. The second multiplexer MUX2 activates the output of the G or B data signal. The first input terminal of the third multiplexer MUX3 is connected to the output terminal of the second DA converter DAC2. The third multiplexer MUX3 activates the output of the B data signal.

The third input terminals of the first to third multiplexers MUX1 to MUX2 are commonly connected to a black voltage line $V_{OFF}$ through which a black voltage is supplied. The black voltage may be referred to as a signal from among grayscale voltages driving the RGBW subpixels that has the same driving voltage while expressing the same grayscale. The black voltage is recognized as a low value, such as 0, within the data driver, and causes a specific subpixel on the display panel 170 to be displayed black. The black voltage may be defined as a common black voltage, a common grayscale voltage, or the like. Since the black voltage is defined as a common black voltage, a common grayscale voltage, or the like, it is possible to supply the black voltage as a single voltage to the input terminals of two or more multiplexers.

The selection terminals of the first to third multiplexers MUX1 to MUX3 are commonly connected to a reference data signal line through which a reference data signal BDATA is supplied. The first to third multiplexers MUX1 to MUX3 use the reference data signal BDATA as a selection signal. In correspondence with the data state (or characteristics) of the reference data signal BDATA, the first to third multiplexers MUX1 to MUX3 activate the output of a signal input through the first input terminals, activate the output of a signal input through the second input terminals, or activate the output of a signal input through the third input terminals. One of the first to third multiplexers MUX1 to MUX3 outputs the black voltage supplied through the third input terminal in correspondence with the data state (or characteristics) of the reference data signal BDATA.

The input terminal of the first amplifier OP1 is connected to the output terminal of the first multiplexer MUX1, and the first amplifier OP1 amplifies the R data signal. The input terminal of the second amplifier OP2 is connected to the output terminal of the second multiplexer MUX2, and the second amplifier OP2 amplifies the G data signal. The input terminal of the third amplifier OP3 is connected to the output terminal of the third multiplexer MUX3, and the third amplifier OP3 amplifies the B data signal. The input terminal of the fourth amplifier OP4 is connected to the output terminal of the third DA converter DAC3, and the fourth amplifier OP4 amplifies the W data signal.

For better understanding the data driver according to the first embodiment of the present disclosure, an exemplary description will be given below to the operation of the data driver according to the data state of color data signals DDATA and a reference data signal BDATA.

FIG. 11A illustrates an exemplary operation of the data driver in the case in which the color data signals DDATA are GBW data signals G, B, and W and the reference data signal BDATA is an R data signal BDATA_r.

When the color data signals DDATA are the GBW data signals and the reference data signal BDATA is the R data signal BDATA_r, the first to third multiplexers MUX1 to MUX3 and the like are controlled such that a black voltage is output instead of the R data signal. In this case, the first to third DA converters DAC1 to DAC3, the first to third multiplexers MUX1 to MUX3, and the first to fourth amplifiers OP1 to OP4 operate as follows:

The first DA converter DAC1 converts the G data signal G driving the green subpixel into an analog format. The second multiplexer MUX2 outputs the G data signal G in response to the activation of the second input terminal connected to the output terminal of the first DA converter DAC1. The second amplifier OP2 amplifies the G data signal output from the second multiplexer MUX2.

The second DA converter DAC2 converts the B data signal B driving the blue subpixel into an analog format. The third multiplexer MUX3 outputs the B data signal in response to the activation of the first input terminal connected to the output terminal of the second DA converter DAC2. The third amplifier OP3 amplifies the B data signal output from the third multiplexer MUX3.

The third DA converter DAC3 converts the W data signal W driving the white subpixel into an analog format. The fourth amplifier OP4 connected to the output terminal of the third DA converter DAC3 amplifies the W data signal output from the third DA converter DAC3.

Since the selection signal is the R data signal BDATA_r, the first multiplexer MUX1 outputs a black voltage $V_{OFF}$ supplied through the third input terminal. At this time, the black voltage $V_{OFF}$ corresponds to a common black voltage causing the subpixel not to emit light. Accordingly, the first amplifier OP1 may or may not amplify the black voltage $V_{OFF}$.

FIG. 11B illustrates an exemplary operation of the data driver in the case in which the color data signals DDATA are RBW data signals R, B, and W and the reference data signal BDATA is a G data signal BDATA_g.

When the color data signals DDATA are the RBW data signals R, B, and W and the reference data signal BDATA is the G data signal BDATA_g, the first to third multiplexers MUX1 to MUX3 or the like are controlled such that a black voltage is output instead of the G data signal. In this case, the first to third DA converters DAC1 to DAC3, the first to third multiplexers MUX1 to MUX3, and the first to fourth amplifiers OP1 to OP4 operate as follows:

The first DA converter DAC1 converts the R data signal R driving the red subpixel into an analog format. The first multiplexer MUX1 outputs the R data signal R in response to the activation of the first input terminal connected to the output terminal of the first DA converter DAC1. The first amplifier OP1 amplifies the R data signal output from the first multiplexer MUX1.

The second DA converter DAC2 converts the B data signal B driving the blue subpixel into an analog format. The third multiplexer MUX3 activates the first input terminal connected to the output terminal of the second DA converter DAC2, outputs the B data signal. The third amplifier OP3 amplifies the B data signal output from the third multiplexer MUX3.

The third DA converter DAC3 converts the W data signal W driving the white subpixel into an analog format. The fourth amplifier OP4 connected to the output terminal of the third DA converter DAC3 amplifies the W data signal output from the third DA converter DAC3.

Since the selection signal is the G data signal BDATA_g, the second multiplexer MUX2 outputs a black voltage $V_{OFF}$ supplied through the third input terminal. At this time, the black voltage $V_{OFF}$ corresponds to a common black voltage causing the subpixel not to emit light. Accordingly, the second amplifier OP2 may or may not amplify the black voltage $V_{OFF}$.

FIG. 11C illustrates an exemplary operation of the data driver in the case in which the color data signals DDATA are RGW data signals R, G, and W and the reference data signal BDATA is a B data signal BDATA_b.

When the color data signals DDATA are the RGW data signals R, G, and W and the reference data signal BDATA is the B data signal BDATA_b, the first to third multiplexers MUX1 to MUX3 and the like are controlled such that a black voltage is output instead of the B data signal.

Since the exemplary operation of the data driver illustrated in FIG. 11C can be easily understood from the descriptions of the FIG. 11A and FIG. 11B, only the first to third DA converters DAC1 to DAC3 and the third multiplexer MUX3 will be described as follows:

The first DA converter DAC1 converts the R data signal R driving the red subpixel into an analog format. The second DA converter DAC2 converts the G data signal G driving the green subpixel into an analog format. The third DA converter DAC3 converts the W data signal W driving the white subpixel into an analog format.

Since the selection signal is the B data signal BDATA_b, the third multiplexer MUX3 outputs a black voltage $V_{OFF}$ supplied through the third input terminal. At this time, the black voltage $V_{OFF}$ corresponds to a common black voltage causing the subpixel not to emit light. Accordingly, the third amplifier OP3 may or may not amplify the black voltage $V_{OFF}$.

It was described, in the first embodiment of the present disclosure, that the multiplexers are positioned downstream of the DA converters and the amplifiers are positioned downstream of the multiplexers. However, the positions of the multiplexers and the amplifiers can be changed as in the following second embodiment.

Second Embodiment

An OLED display according to the second embodiment of the present disclosure outputs data signals in the same fashion as in the first embodiment of the present disclosure described with reference to FIG. 1 to FIG. 7. In the second embodiment, the position and the connecting relationship of the multiplexers and the amplifiers will be mainly described since they differ from those of the first embodiment of the present disclosure, and FIG. 1 to FIG. 7 will be referred to as for the remaining elements.

Hereinafter, with reference to one pixel driver included in the data driver 150, a related art and the second embodiment of the present disclosure will be comparatively described.

Figure 12A:
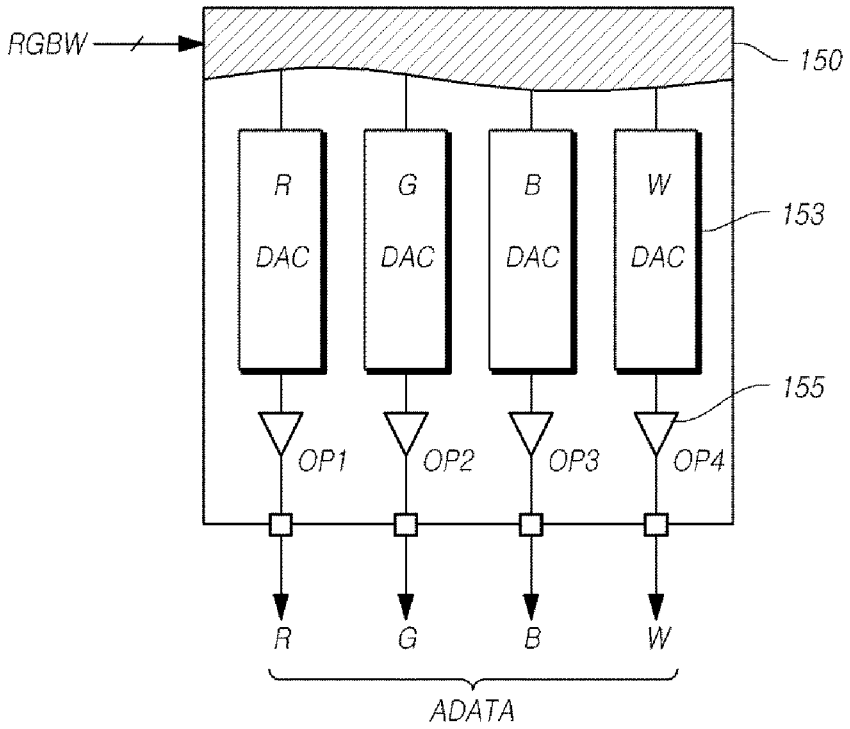
FIG. 12A and FIG. 12B comparatively illustrate part of the configuration of a data driver of the related art and part of the configuration of the data driver according to the second embodiment of the present disclosure.
Figure 12B:
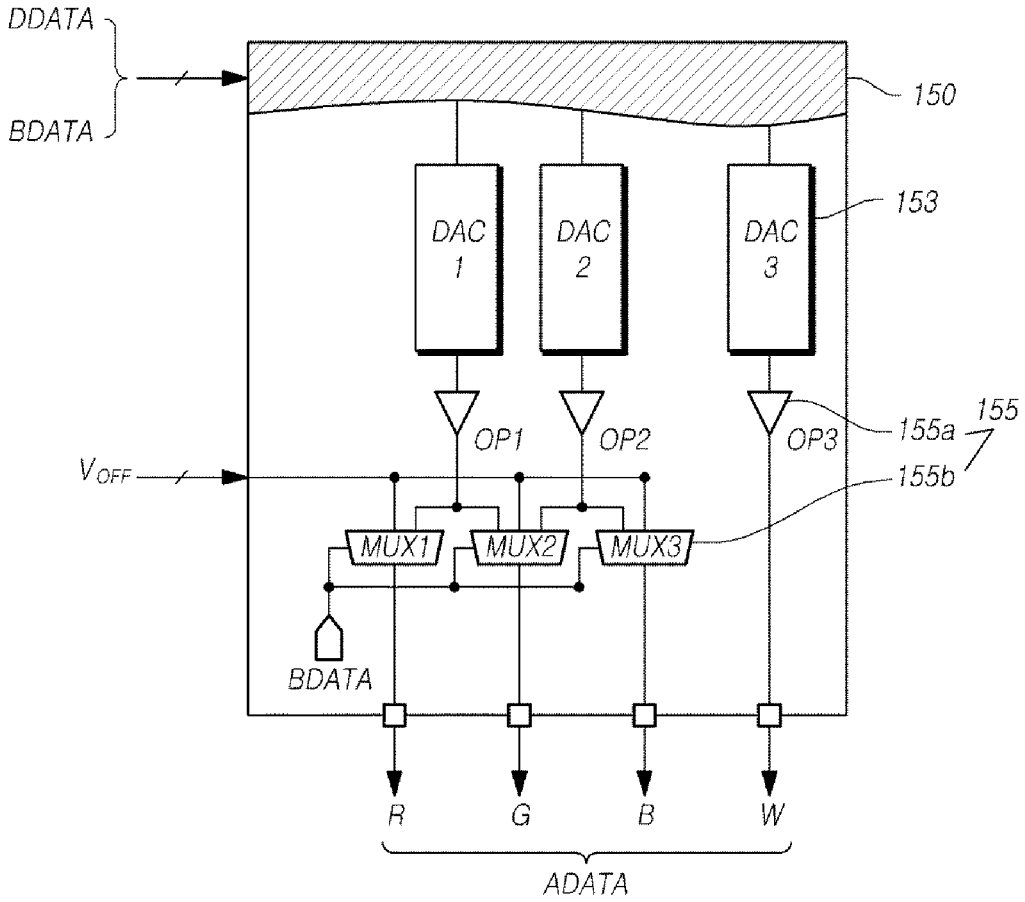

FIG. 12A illustrates part of the configuration of a data driver of the related art, and FIG. 12B illustrates part of the configuration of the data driver according to the second embodiment of the present disclosure.

As illustrated in FIG. 12A, in a typical data driver 150, one pixel driver includes a DA converting circuit 153 and an amplifier circuit 155*a*. Specifically, the DA converting circuit 153 includes a red DA converter R DAC, a green DA converter G DAC, a blue DA converter B DAC, and a white DA converter W DAC. The red DA converter R DAC converts an R data signal driving a red subpixel into an analog format. The green DA converter G DAC converts a G data signal driving a green subpixel into an analog format. The blue DA converter B DAC converts a B data signal driving a blue subpixel into an analog format. The white DA converter W DAC converts a W data signal driving a white subpixel into an analog format.

An output circuit 155 includes a first amplifier OP1, a second amplifier OP2, a third amplifier OP3, and a fourth amplifier OP4. The input terminal of the first amplifier OP1 is connected to the output terminal of the red DA converter R DAC. The first amplifier OP1 amplifies the R data signal. The input terminal of the second amplifier OP2 is connected to the output terminal of the green DA converter G DAC. The second amplifier OP2 amplifies the G data signal. The input terminal of the third amplifier OP3 is connected to the output terminal of the blue DA converter B DAC. The third amplifier OP3 amplifies the B data signal. The input terminal of the fourth amplifier OP4 is connected to the output terminal of the white DA converter W DAC. The fourth amplifier OP4 amplifies the W data signal.

As described with reference to FIG. 9A, the typical data driver 150 has the digital data signals DDATA in the above-described format supplied from the timing controller. Accordingly, the typical data driver 150 requires four DA converters for the DA converting circuit 153 and four amplifiers for the output circuit 155.

The data driver 150 converts the digital data signals DDATA into analog RGBW data signals ADATA using the four DA converters of the DA converting circuit 153 and the four amplifiers of the output circuit 155 provided in correspondence with the number of the RGBW data signals Red Data, Green Data, Blue Data, and White Data (see FIG. 9A), and outputs the analog RGBW data signals ADATA.

In the design of the data driver 150, the DA converting circuit 153 takes the largest area from among the circuits within the data driver 150. Therefore, in the data driver 150 of the related art, the increased number of the DA converters of the DA converting circuit 153 increases the size and fabrication costs of the data driver compared to the data driver using RGB data signals only.

As illustrated in FIG. 12B, in the data driver 150 according to the second embodiment of the present disclosure, one pixel driver includes a DA converting circuit 153 and an output circuit 155. Specifically, the DA converting circuit 153 includes a first DA converter DAC1 a second DA converter DAC2 that selectively drive red, green, blue, and white subpixels and a third DA converter DAC3 that drives a white subpixel.

Each of the first DA converter DAC1 and the second DA converter DAC2 selectively receives data signals for at least two colors, and converts the data signal of one color of the at least two colors into an analog format. The third DA converter DAC3 receives a data signal for one color, and converts the data signal for the one fixed color into an analog format.

The output circuit 155 includes an amplifier circuit 155*a* and a multiplexer circuit 155*b*. The amplifier circuit 155*a* includes a first amplifier OP1, a second amplifier OP2, and a third amplifier OP3. The input terminal of the first amplifier OP1 is connected to the output terminal of the first DA converter DAC1. The input terminal of the second amplifier OP2 is connected to the output terminal of the second DA converter DAC2. The input terminal of the third amplifier OP3 is connected to the output terminal of the third DA converter DAC3.

The multiplexer circuit 155*b* includes a first multiplexer MUX1, a second multiplexer MUX2, and a third multiplexer MUX3. The input terminal of the first multiplexer MUX1 is connected to the output terminal of the first amplifier OP1. The first input terminal of the second multiplexer MUX2 is connected to the output terminal of the second amplifier OP2, and the second input terminal of the second multiplexer MUX2 is connected to the output terminal of the first amplifier OP1. The first input terminal of the third multiplexer MUX3 is connected to the output terminal of the second amplifier OP2. The third input terminals of the first to third multiplexers MUX1 to MUX3 are commonly connected to a black voltage line $V_{OFF}$ through which a black voltage is supplied. The selection terminals of the first to third multiplexers MUX1 to MUX3 are commonly connected to a signal line through which a reference data signal BDATA is transferred. In the above description, the multiplexer circuit 155*b* was taken for the sake of explanation. However, the present disclosure is not limited thereto since the multiplexer circuit may be substituted with any circuit (e.g. a transistor) able to output a specific data signal in correspondence with a specific selection signal.

The data driver 150 according to the second embodiment of the present disclosure receives the digital data signals DDATA and BDATA having the above-described format (see the above description with reference to FIG. 9). As described above, the color data signals DDATA include three data signals selected from among the RGBW data signals. For example, the color data signals DDATA are in the form of GBW data signals, RBW data signals, or RGW data signals in which one signal from among the RGBW data signals is omitted, with the W data signal being fixed. The reference data signal BDATA includes the unselected signal from among the RGB data signal.

Since the data signals having the above-described format are output from the timing controller, the DA converting circuit 153 of the data driver 150 includes three DA converters in correspondence with the number of the color data signals DDATA. Accordingly, the numbers of DA converters and the amplifiers of the data driver 150 according to the second embodiment of the present disclosure can be significantly reduced with the increasing number of pixels (or the increasing resolution) of the display panel compared to those of the data driver of the related art. Since the numbers of DA converters and the amplifiers of the data driver 150 according to the second embodiment of the present disclosure can be reduced, it is possible to design the data driver having a smaller size and reduce design costs.

In addition, the amplifier circuit 155*a* of the data driver 150 according to the second embodiment of the present disclosure can be constituted with only the first amplifier OP1, the second amplifier OP2, and the third amplifier OP3, the number of which is smaller than the number of the amplifiers of the amplifier circuit 155*a* of the data driver 150 according to the first embodiment of the present disclosure. Accordingly, the data driver 150 according to the second embodiment of the present disclosure may be suitable to be applied to a relatively smaller display device.

For better understanding of the data driver according to the second embodiment of the present disclosure, an exemplary description of will be added below.

Figure 13:
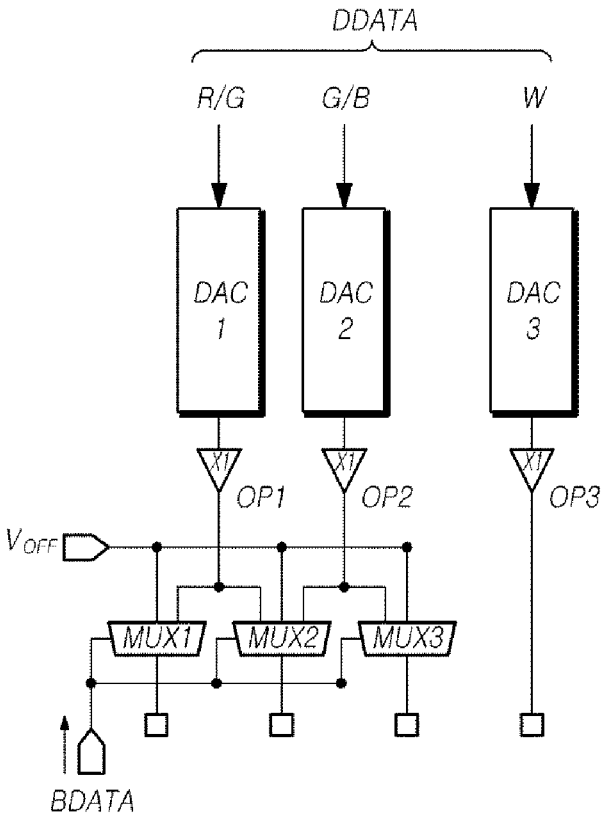
FIG. 13 illustrates an exemplary partial configuration of the data driver according to the second embodiment of the present disclosure.
Figure 14A:
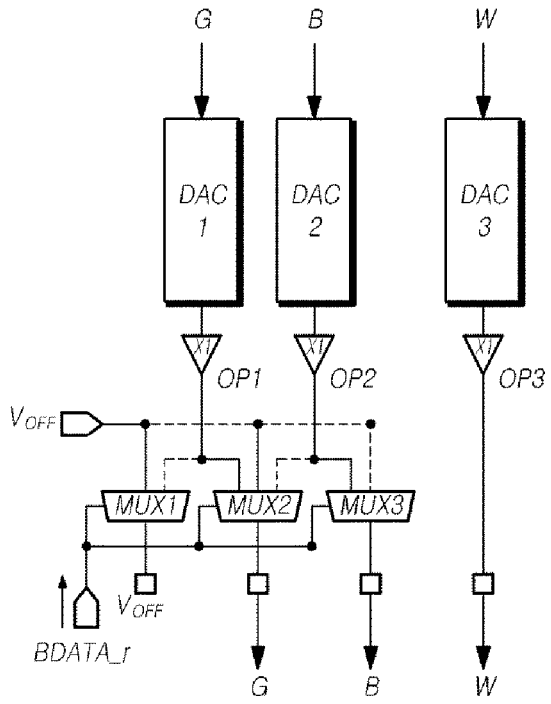
FIG. 14A, FIG. 14B, and FIG. 14C illustrate exemplary operations of the data driver according to the second embodiment of the present disclosure.
Figure 14B:
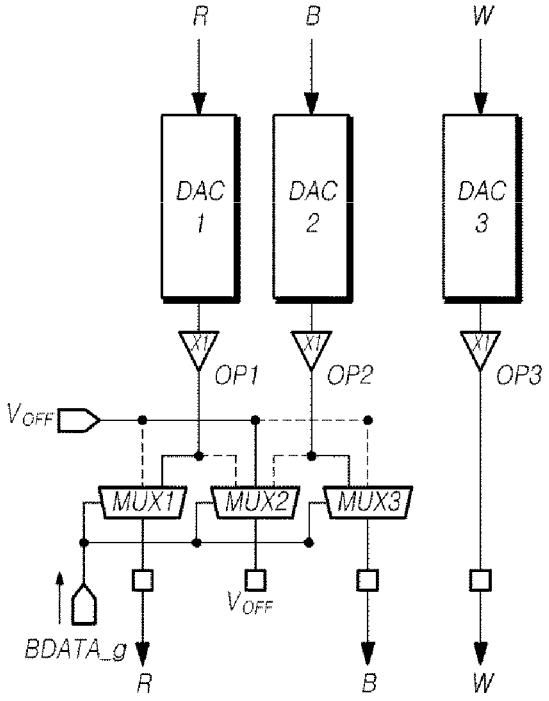
Figure 14C:
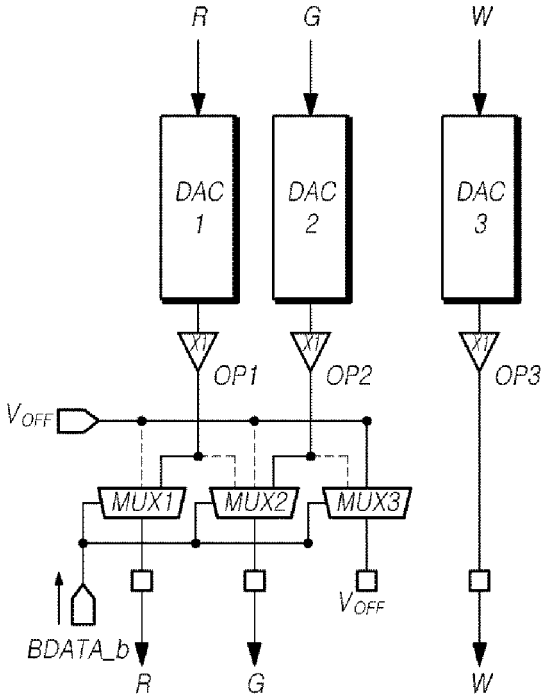

FIG. 13 illustrates an exemplary partial configuration of the data driver according to the second embodiment of the present disclosure, and FIG. 14A, FIG. 14B, and FIG. 14C illustrate exemplary operations of the data driver according to the second embodiment of the present disclosure.

As illustrate in FIG. 13, each of the first DA converter DAC1 and the second DA converter DAC2 selectively receives data signals for at least two colors, and converts the data signal for one color from among the received data signals into an analog format. The third DA converter DAC3 receives a data signal for one color, and converts the data signal for the one fixed color into an analog format.

For example, the first DA converter DAC1 converts an R or G data signal R/G driving the red or green subpixel into an analog format. The second DA converter DAC2 converts a G or B data signal G/B driving the green or blue subpixel into an analog format. The third DA converter DAC3 converts a W data signal W driving the white subpixel into an analog format.

The input terminal of the first amplifier OP1 is connected to the output terminal of the first DA converter DAC1, and the first amplifier OP1 amplifies the R or G data signal R/G. The input terminal of the second amplifier OP2 is connected to the output terminal of the second DA converter DAC2, and the second amplifier OP2 amplifies the G or B data signal G/B. The input terminal of the third amplifier OP3 is connected to the output terminal of the third DA converter DAC3, and the third amplifier OP3 amplifies the W data signal W.

The first input terminal of the first multiplexer MUX1 is connected to the output terminal of the first amplifier OP1. The first multiplexer MUX1 activates the output of the R data signal. The first input terminal of the second multiplexer MUX2 is connected to the output terminal of the second amplifier OP2, and the second input terminal of the second multiplexer MUX2 is connected to the output terminal of the first amplifier OP1. The second multiplexer MUX2 activates the output of the G or B data signal. The first input terminal of the third multiplexer MUX3 is connected to the output terminal of the second amplifier OP2. The third multiplexer MUX3 activates the output of the B data signal.

The first to third input terminals of the first to third multiplexers MUX1 to MUX2 are commonly connected to a black voltage line $V_{OFF}$ through which a black voltage is supplied. The selection terminals of the first to third multiplexers MUX1 to MUX3 are commonly connected to a reference data signal line through which a reference data signal BDATA is supplied.

The first to third multiplexers MUX1 to MUX3 use the reference data signal BDATA as a selection signal. In correspondence with the data state (or characteristics) of the reference data signal BDATA, the first to third multiplexers MUX1 to MUX3 activate the output of a signal input through the first input terminals, activate the output of a signal input through the second input terminals, or activate the output of a signal input through the third input terminals. One of the first to third multiplexers MUX1 to MUX3 outputs the black voltage supplied through the third input terminal in correspondence with the data state (or characteristics) of the reference data signal BDATA.

For better understanding the data driver according to the second embodiment of the present disclosure, an exemplary description will be given below to the operation of the data driver according to the data state of color data signals DDATA and a reference data signal BDATA.

FIG. 14A illustrates an exemplary operation of the data driver in the case in which the color data signals DDATA are GBW data signals G, B, and W and the reference data signal BDATA is an R data signal BDATA_r.

When the color data signals DDATA are the GBW data signals G, B, and W and the reference data signal BDATA is the R data signal BDATA_r, the first to third multiplexers MUX1 to MUX3 and the like are controlled such that a black voltage is output instead of the R data signal. In this case, the first to third DA converters DAC1 to DAC3, the first to third amplifiers OP1 to OP3, and the first to third multiplexers MUX1 to MUX3 operate as follows:

The first DA converter DAC1 converts the G data signal G driving the green subpixel into an analog format. The first amplifier OP1 amplifies the G data signal output from the first DA converter DAC1. The second multiplexer MUX2 outputs the G data signal in response to the activation of the second input terminal connected to the output terminal of the first amplifier OP1.

The second DA converter DAC2 converts the B data signal B driving the blue subpixel into an analog format. The second amplifier OP2 amplifies the B data signal output from second DA converter DAC2. The third multiplexer MUX3 outputs the B data signal in response to the activation of the first input terminal connected to the output terminal of the second amplifier OP2.

The third DA converter DAC3 converts the W data signal W driving the white subpixel into an analog format. The third amplifier OP3 amplifies the W data signal output from the third DA converter DAC3.

Since the selection signal is the R data signal BDATA_r, the first multiplexer MUX1 outputs a black voltage $V_{OFF}$ supplied through the third input terminal. At this time, the black voltage $V_{OFF}$ corresponds to a common black voltage causing the subpixel not to emit light.

FIG. 14B illustrates an exemplary operation of the data driver in the case in which the color data signals DDATA are RBW data signals R, B, and W and the reference data signal BDATA is a G data signal BDATA_g.

When the color data signals DDATA are the RBW data signals R, B, and W and the reference data signal BDATA is the G data signal BDATA_g, the first to third multiplexers MUX1 to MUX3 or the like are controlled such that a black voltage is output instead of the G data signal. In this case, the first to third DA converters DAC1 to DAC3, the first to third amplifiers OP1 to OP3, and the first to third multiplexers MUX1 to MUX3 operate as follows:

The first DA converter DAC1 converts the R data signal R driving the red subpixel into an analog format. The first amplifier OP1 amplifies the R data signal output from the first DA converter DAC1. The first multiplexer MUX1 outputs the R data signal in response to the activation of the first input terminal connected to the output terminal of the first amplifier OP1.

The second DA converter DAC2 converts the B data signal B driving the blue subpixel into an analog format. The second amplifier OP2 amplifies the B data signal output from second DA converter DAC2. The third multiplexer MUX3 outputs the B data signal in response to the activation of the first input terminal connected to the output terminal of the second amplifier OP2.

The third DA converter DAC3 converts the W data signal W driving the white subpixel into an analog format. The third amplifier OP3 amplifies the W data signal output from the third DA converter DAC3.

Since the selection signal is the G data signal BDATA_g, the second multiplexer MUX2 outputs a black voltage $V_{OFF}$ supplied through the third input terminal. At this time, the black voltage $V_{OFF}$ corresponds to a common black voltage causing the subpixel not to emit light.

FIG. 14C illustrates an exemplary operation of the data driver in the case in which the color data signals DDATA are RGW data signals R, G, and W and the reference data signal BDATA is a B data signal BDATA_b.

When the color data signals DDATA are the RGW data signals R, G, and W and the reference data signal BDATA is the B data signal BDATA_b, the first to third multiplexers MUX1 to MUX3 and the like are controlled such that a black voltage is output instead of the B data signal.

Since the exemplary operation of the data driver illustrated in FIG. 14C can be easily understood from the descriptions of the FIG. 14A and FIG. 14B, only the first to third DA converters DAC1 to DAC3 and the third multiplexer MUX3 will be described as follows:

The first DA converter DAC1 converts the R data signal R driving the red subpixel into an analog format. The second DA converter DAC2 converts the G data signal G driving the green subpixel into an analog format. The third DA converter DAC3 converts the W data signal W driving the white subpixel into an analog format.

Since the selection signal is the B data signal BDATA_b, the third multiplexer MUX3 outputs a black voltage $V_{OFF}$ supplied through the third input terminal. At this time, the black voltage $V_{OFF}$ corresponds to a common black voltage causing the subpixel not to emit light.

As apparent from the first and second embodiments of the present disclosure, the data driver according to the present disclosure can output four data signals (or data voltages) using three DA converters and one reference data signal or voltage. For this, the first embodiment uses the DA converters, the amplifiers, and the multiplexers situated between the DA converters and the amplifiers, whereas the second embodiment uses the DA converters, the multiplexers, and the amplifiers situated between the DA converters and the multiplexers.

In addition, as apparent from the first and second embodiments of the present disclosure, the data driver according to the present disclosure uses data signals having a signal format by which the positions of the color data signals and the reference data signal are determined.

Furthermore, as apparent from the first and second embodiments of the present disclosure, in the data driver according to the present disclosure, the terminal through which a common black voltage or a common grayscale voltage is output is variable in correspondence with the data state (or characteristics) of the reference data signal.

The embodiments of the present disclosure as described above can reduce the size of the data driver by decreasing the number of the DA converters. In addition, since the number of bits of data signals output from the timing controller is reduced, the frequency of signals input to the data driver can be reduced. Furthermore, the present disclosure can reduce the static power consumption of the data driver since the number of the DA converters or amplifiers is reduced. In addition, according to the present disclosure, it is possible to reduce the fabrication cost of the data driver by reducing the number of the DA converters or amplifiers.

The foregoing descriptions and the accompanying drawings have been presented in order to explain the certain principles of the present disclosure. A person skilled in the art to which the present disclosure relates can make many modifications and variations by combining, dividing, substituting for, or changing the elements without departing from the principle of the disclosure. The foregoing embodiments disclosed herein shall be interpreted as illustrative only but not as limitative of the principle and scope of the disclosure. It should be understood that the scope of the disclosure shall be defined by the appended claims and all of their equivalents fall within the scope of the disclosure.

What is claimed is:

1. A data driver for driving a pixel of a display device, the pixel including a first color sub-pixel, a second color sub-pixel, a third color sub-pixel, and a fourth color sub-pixel, the data driver being inputted with a digital signal including a first digital color signal, a second digital color signal, a third digital color signal, and a fourth digital color signal corresponding to the first color sub-pixel, the second color sub-pixel, the third color sub-pixel, and the fourth color sub-pixel, respectively, the data driver comprising:

a digital-to-analog converting circuit converting the first digital color signal, the second digital color signal, and the third digital color signal into a first color analog signal, a second color analog signal, and a third color analog signal, respectively, wherein the fourth digital color signal is a reference signal, and the first, second, and third digital color signals having different values than the fourth digital color signal; and an output circuit disposed downstream of the digital-to-analog converting circuit, wherein the output circuit is inputted the first color analog signal, the second color analog signal, the third color analog, signal, and a black voltage separate from the first, the second, and the third color analog signals, the black voltage also being separate from the first, the second, the third, and the fourth digital color signals, wherein the output circuit outputs the first color analog signal, the second color analog signal, and the third color analog signal to the first color sub-pixel, the second color sub-pixel, and the third color sub-pixel, respectively, and the output circuit outputs the black voltage to the fourth color sub-pixel in place of an analog signal associated with a color of the fourth digital color signal, the output circuit omitting the analog signal associated with the color of the fourth digital color signal from output of the output circuit; wherein the output circuit comprises a first multiplexer, a second multiplexer, and a third multiplexer positioned downstream of the digital-to-analog converting circuit, wherein the first multiplexer and the second multiplexor output the first color analog signal and the second color analog signal, respectively, and the third multiplexer outputs the black voltage for the fourth color sub-pixel.

2. The data driver according to claim 1, wherein the third color analog signal corresponds to white, the third color analog signal passing through the output circuit.

3. The data driver according to claim 2, wherein the digital-to-analog converting circuit comprises a first digital-to-analog converter, a second digital-to-analog converter, and a third digital-to-analog converter inputted with the first digital color signal, the second digital color signal, and the third digital color signal, respectively, for conversion, and the output circuit further comprises a first amplifier, a second amplifier, and a third amplifier, the first amplifier and the second amplifier inputted with the first color analog signal and the second color analog signal, respectively, from the first multiplexer and the second multiplexer, respectively, and the third amplifier inputted the third color analog signal from the third digital-to-analog converter.

4. The data driver according to claim 1, wherein the digital-to-analog converting circuit comprises a first, second, and third digital-to-analog converter outputting the first color analog signal, the second color analog signal, and the third color analog signal, respectively, and the output circuit further comprises three amplifiers positioned downstream of the first, second, and third digital-to-analog converters, wherein two amplifiers of the three amplifiers are positioned between the first and second digital-to-analog converters and the three multiplexers, and one amplifier of the three amplifiers is connected to the third digital-to-analog converter.

5. A display device comprising:

a display panel;

a data driver driving a pixel of the display panel, the pixel including a first color sub-pixel, a second color sub-pixel, a third color sub-pixel, and a fourth color sub-pixel, the data driver being inputted with a digital signal including a first digital color signal, a second digital color signal, a third digital color signal, and a fourth digital color signal corresponding to the first color sub-pixel, the second color sub-pixel, the third color sub-pixel, and the fourth color sub-pixel, respectively, wherein the data driver comprises:

a digital-to-analog converting circuit converting the first digital color signal, the second digital color signal, and the third digital color signal into a first color analog signal, a second color analog signal, and a third color analog signal, respectively, wherein the fourth digital color signal is a reference signal, and the first, second, and third digital color signals having different values than the fourth digital color signal; and an output circuit disposed downstream of the digital-to-analog converting circuit, wherein the output circuit is inputted the first color analog signal, the second color analog signal, the third color analog signal, and a black voltage separate from the first, the second, and the third color analog signals, the black voltage also being separate from the first, the second, the third, and the fourth digital color signals, wherein the output circuit outputs the first color analog signal, the second color analog signal, and the third color analog signal to the first color sub-pixel, the second color sub-pixel, and the third color sub-pixel, respectively, and the output circuit outputs the black voltage to the fourth color sub-pixel in place of an analog signal associated with a color of the fourth digital color signal, the output circuit omitting the analog signal associated with the color of the fourth digital color signal from output of the output circuit; wherein the output circuit comprises a first multiplexer, a second multiplexer, and a third multiplexer positioned downstream of the digital-to-analog converting circuit, wherein the first multiplexer and the second multiplexer output the first color analog signal and the second color analog signal, respectively, and the third multiplexer outputs the black voltage for the fourth color sub-pixel;

a timing controller controlling the data driver; and a system board supplying a plurality of signals to the timing controller.

6. The display device according to claim 5, wherein the third color analog signal corresponds to white, the third color analog signal passing through the output circuit.

7. The display device according to claim 6, wherein the digital-to-analog converting circuit comprises a first digital-to-analog converter, a second digital-to-analog converter, and a third digital-to-analog converter inputted with the first digital color signal, the second digital color signal, and the third digital color signal, respectively, for conversion, and the output circuit further comprises a first amplifier, a second amplifier, and a third amplifier, the first amplifier and the second amplifier inputted with the first color analog signal and the second color analog signal, respectively, from the first multiplexer and the second multiplexer, respectively, the third amplifier inputted with the third color analog signal from the third digital-to-analog converter.

8. The display device according to claim 6, wherein the digital-to-analog converting circuit comprises a first, second, and third digital-to-analog converter outputting the first color analog signal, the second color analog signal, and the third color analog signal, respectively, and the output circuit further comprises three amplifiers positioned downstream of the first, second, and third digital-to-analog converters, wherein two amplifiers of the three amplifiers are positioned between the first and second digital-to-analog converters and the three multiplexers, and one amplifier of the three amplifiers is connected to the third digital-to-analog converter.

9. The display device according to claim 5, wherein one of the system board and the timing controller converts the digital signal supplied from an external source from RGB data signals into RGBW data signals.

10. The display device according to claim 9, wherein data of the first digital color signal, the second digital color signal, and the third digital color signal are each set to 10 bits, and data of the reference signal is set to 2 bits.

11. A data driver for driving a light emitting diode (LED) display including a plurality of pixels, one of the pixels including a first color subpixel, a second color subpixel, a third color subpixel, and a fourth color subpixel, the data driver being inputted with a digital signal including a first digital color signal, a second digital color signal, a third digital color signal, and a fourth digital color signal, the data driver comprising:

a digital-to-analog converting circuit to convert the first digital color signal, the second digital color signal, and the third digital color signal to a first color analog signal, a second color analog signal, and a third color analog signal, respectively; and an output circuit coupled to the digital-to-analog converting circuit, the output circuit being inputted the first color analog signal, the second color analog signal, the third color analog signal, and a black voltage signal separate from the first, the second, and the third color analog signals, the black voltage signal also being separate from the first, the second, the third, and the fourth digital color signals, the output circuit outputting the first color analog signal to the first color subpixel, the second color analog signal to the second color subpixel, the black voltage signal to the third color subpixel in place of an analog signal associated with a color of the fourth digital color signal, and the third color analog signal to the fourth color subpixel, the output circuit omitting the analog signal associated with the color of the fourth digital color signal from output of the output circuit; wherein the output circuit comprises a first multiplexer, a second multiplexer, and a third multiplexer positioned downstream of the digital-to-analog converting circuit, wherein the first multiplexer and the second multiplexer output the first color analog signal and the second color analog signal, respectively, and the third multiplexer outputs the black voltage for the fourth color sub-pixel.

12. The data driver of claim 11, wherein the digital-to-analog converting circuit comprises a first digital-to-analog converter converting the first digital color signal to the first color analog signal, a second digital-to-analog converter Converting the second digital color signal to the second color analog signal, and a third digital-to-analog converter converting the third digital color signal to the third color analog signal.

13. The data driver of claim 12, wherein the output circuit comprises: one or more multiplexers coupled to the first digital-to-analog converter and the second digital-to-analog converter and selectively outputting the first color analog signal to the first color subpixel, the second color analog signal to the second color subpixel, and the black voltage signal to the third color subpixel in response to a reference data signal, the reference data signal indicating that the third color subpixel is to be driven by the black voltage signal.

14. The data driver of claim 13, wherein the first digital color signal and the second digital color signal each has luminance values greater than a luminance value of the third digital color signal.

15. The data driver of claim 13, wherein the output circuit further comprises: a first amplifier, a second amplifier, and a third amplifier coupled to the one or more multiplexers, the first amplifier amplifying the first color analog signal for output to the first color subpixel, the second amplifier amplifying the second color analog signal for output to the second color subpixel, and the third amplifier amplifying the black voltage signal for output to the third color subpixel; and a fourth amplifier coupled to the third digital-to-analog converter, the fourth amplifier amplifying the third color analog signal for output to the fourth color subpixel.

16. The data driver of claim 11, wherein the first digital color signal and the second digital color signal correspond to two selected from red, green, and blue digital color signals of RGBW data, and wherein the third digital color signal is a white digital color signal of the RGBW data.

17. A light-emitting diode (LED) display device, comprising:

a display panel including a plurality of pixels, one of the pixels including a first color subpixel, a second color subpixel, a third color subpixel, and a fourth color subpixel;

a system board receiving RGB data signals for driving the display panel and generating, based on the RGB data signals, a first digital color signal, a second digital color signal, a third digital color signal, a fourth digital color signal, and a reference data signal;

a digital-to-analog, converting circuit to convert the first digital color signal, the second digital color signal, and the third digital color signal to a first color analog signal, a second color analog signal, and a third color analog signal, respectively; and an output circuit coupled to the digital-to-analog converting circuit, the output circuit being inputted the first color analog signal, the second color analog signal, the third color analog signal, and a black voltage signal separate from the first, the second, and the third color analog signals, the black voltage signal also being separate from the first, the second, and the third digital color signals, wherein the output circuit outputs the first color analog signal to the first color subpixel, the second color analog signal to the second color subpixel, the black voltage signal to the third color subpixel in place of an analog signal associated with a color of the fourth digital color signal, and the third color analog signal to the fourth color subpixel, the output circuit omitting the analog signal associated with the color of the fourth digital color signal from output of the output circuit; wherein the output circuit comprises a first multiplexer, a second multiplexer, and a third multiplexer positioned downstream of the digital-to-analog, converting circuit, wherein the first multiplexer and the second multiplexer output the first color analog signal and the second color analog signal, respectively, and the third multiplexer outputs the black voltage for the fourth color sub-pixel.

18. The LED display device of claim 17: wherein the digital-to-analog converting circuit comprises a first digital-to-analog converter converting the first digital color signal to the first color analog signal, a second digital-to-analog converter converting the second digital color signal to the second color analog signal, and a third digital-to-analog converter converting the third digital color signal to the third color analog signal; and wherein the output circuit comprises one or more multiplexers coupled to the first digital-to-analog converter and the second digital-to-analog converter and selectively outputting the first color analog signal to the first color subpixel, the second color analog signal to the second color subpixel, and the black voltage signal to the third color subpixel in response to a reference data signal, the reference data signal indicating that the third color subpixel is to be driven by the black voltage signal.

19. The LED display device of claim 18, wherein the output circuit further comprises: a first amplifier, a second amplifier, and a third amplifier coupled to the one or more multiplexers, the first amplifier amplifying the first color analog signal for output to the first color subpixel, the second amplifier amplifying the second color analog signal for output to the second color subpixel, and the third amplifier amplifying the black voltage signal for output to the third color subpixel; and a fourth amplifier coupled to the third digital-to-analog converter, the fourth amplifier amplifying the third color analog signal for output to the fourth color subpixel.

20. The LED display device of claim 17, wherein the first digital color signal and the second digital color signal correspond to two selected from red, green, and blue digital color signals of RGBW data, and wherein the fourth digital color signal is a white digital color signal of the RGBW data.

* * * * *